United States Patent [19]

Graham et al.

[11] 4,145,971

[45] Mar. 27, 1979

[54] ELECTRONIC TIME DELAY SAFETY AND ARMING MECHANISM

[75] Inventors: R. Gordon Graham, Mesa; Norman L. Jackson, Tempe, both of Ariz.

[73] Assignee: Motorola, Inc., Schaumburg, Ill.

[21] Appl. No.: 843,621

[22] Filed: Oct. 19, 1977

[51] Int. Cl.[2] ..... F42C 15/40; F42C 15/22

[52] U.S. Cl. ..... 102/232; 102/215; 102/245; 102/255

[58] Field of Search ..... 102/206, 207, 210, 215, 102/216, 220, 231–233, 235, 237, 238, 244, 245, 247, 251, 254, 255, 262, 264, 265

[56] References Cited

U.S. PATENT DOCUMENTS

| | | | |
|---|---|---|---|
| 2,458,470 | 1/1949 | Hafstad et al. | 102/231 |
| 2,737,890 | 3/1956 | Brode | 102/235 |
| 2,919,648 | 1/1960 | Jordan | 102/245 |
| 3,760,732 | 9/1973 | Schuster et al. | 102/215 |
| 3,890,901 | 6/1975 | Anderson et al. | 102/255 |
| 3,967,554 | 7/1976 | Troyer, Jr. | 102/215 |

*Primary Examiner*—Charles T. Jordan

*Attorney, Agent, or Firm*—Eugene A. Parsons

[57] ABSTRACT

In a fuse for spinning explosive projectiles, a base member having a sliding member mounted thereon for generally radially outwardly sliding movement in response to centrifugal force, a shear pin holding the sliding member in a safe position with a piston actuator mounted to break the shear pin upon proper actuation thereof to allow the sliding member to move to an arm position, a detonator mounted so as to be properly positioned only when the sliding member has moved to the arm position, switch means normally maintaining the piston actuator and the detonator in a safe mode and operating in response to centrifugal force and the movement of the sliding member to provide a circuit for the actuation of the piston actuator and the detonator, a battery actuatable in response to setback and spin of the projectile, and redundant and sequential electrical timing means connected to the battery and the switch means for activating the piston actuator a predetermined time after the battery is activated and for arming the detonator after the piston actuator breaks the shear pin.

13 Claims, 4 Drawing Figures

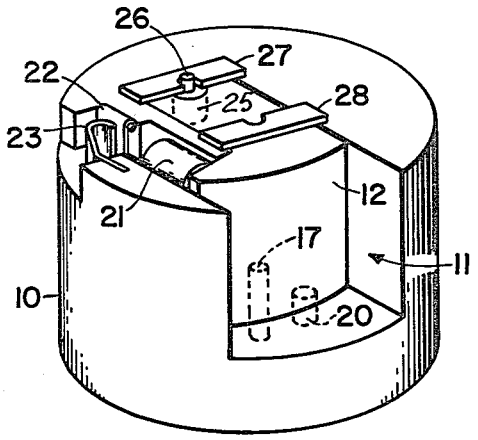
FIG. 1
FIG. 2
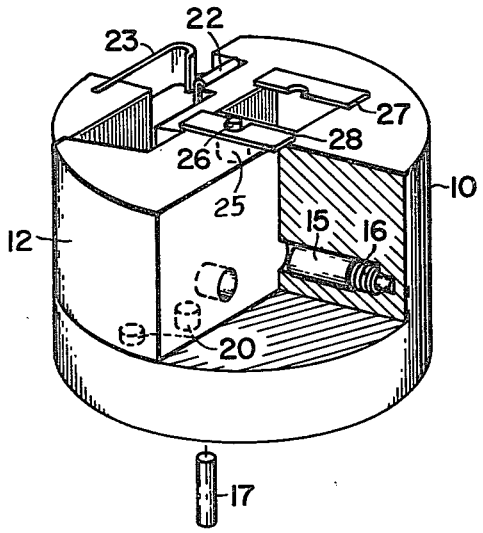
FIG. 3
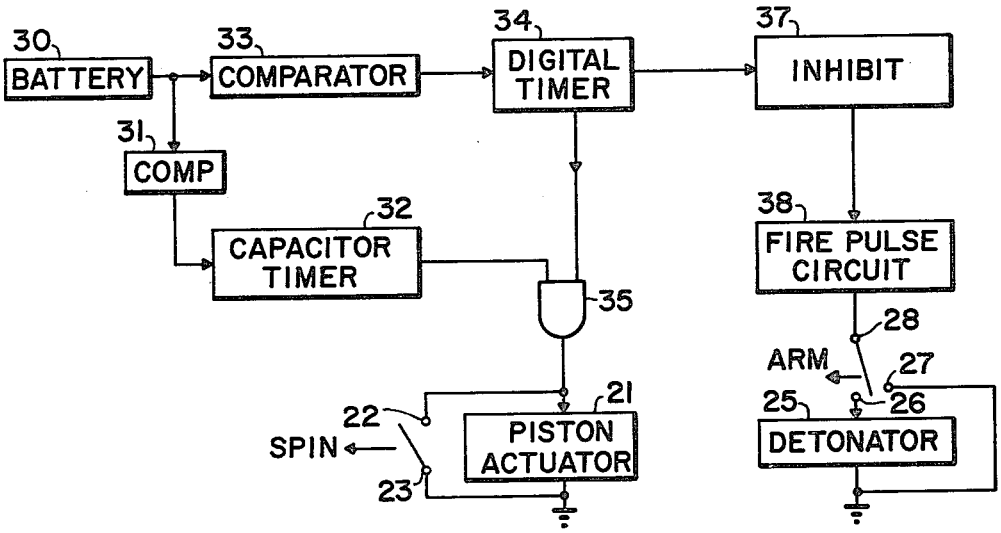

ELECTRONIC TIME DELAY SAFETY AND ARMING MECHANISM

BACKGROUND OF THE INVENTION

In fuses for explosive projectiles and the like it is essential that the fuse not be armed prior to actual firing of the projectile or missile from a gun or the like. Further, the projectile or missile should travel a safe distance from the firing device before arming so that accidental explosions at the firing device cannot occur. Because the fuse is destroyed with the projectile, low cost is essential and, in addition, high reliability and safety must be incorporated. In prior art safety and arming mechanisms dashpots, escapements, chemical reactions, enertia motors and unwinder springs are utilized, all of which tend to reduce the miniaturization and reliability and increase the cost.

SUMMARY OF THE INVENTION

The present invention utilizes a linear motion slide member which is placed off the center axis of the fuse and which, upon moving to the armed position, positions the detonator in an arm position. The slide member is held in position by a setback pin, a spin detent pin and a shear pin. The shear pin is broken by a piston actuator which cannot be activated until a contact grounding both sides of the piston actuator is opened by spinning of the projectile. The detonator also is grounded on both sides until firing of the piston actuator and movement of the slide member opens contacts and connects the detonator into an electrical circuit. Also, a battery is activated by setback and spin and starts redundant and sequential timing circuits which operate the piston actuator a predetermined time after setback and which then arm the detonator after the piston actuator is operated. Because of the single linear motion slide member, the device can be constructed with low cost, high reliability and safety. Further, the fuse is easily miniaturized and production thereof may be automated. Because of the electronic time delay and the one mechanical moving part, the fuse is shock insensitive and cannot be armed during assembly or prior to actual firing of the projectile.

It is an object of the present invention to provide a new and improved electronic time delay safety and arming mechanism.

It is a further object of the present invention to provide an electronic time delay safety and arming mechanism which incorporates all of the advantages of low cost, high reliability, safety, miniaturization, automated production and shock insensitivity.

These and other objects of this invention will become apparent to those skilled in the art upon consideration of the accompanying specification, claims and drawings.

BRIEF DESCRIPTION OF THE DRAWINGS

Referring to the drawings, wherein like characters indicate like parts throughout the Figures:

FIG. 1 is a perspective view of a safety and arming mechanism embodying the present invention, in the safe position;

FIG. 2 is a perspective view similar to FIG. 1 rotated 90° and with the mechanism in the arm position;

FIG. 3 is a block diagram of electronic circuitry for the safety and arming mechanism of FIGS. 1 and 2.

DESCRIPTION OF THE PREFERRED EMBODIMENT

Figure 4:
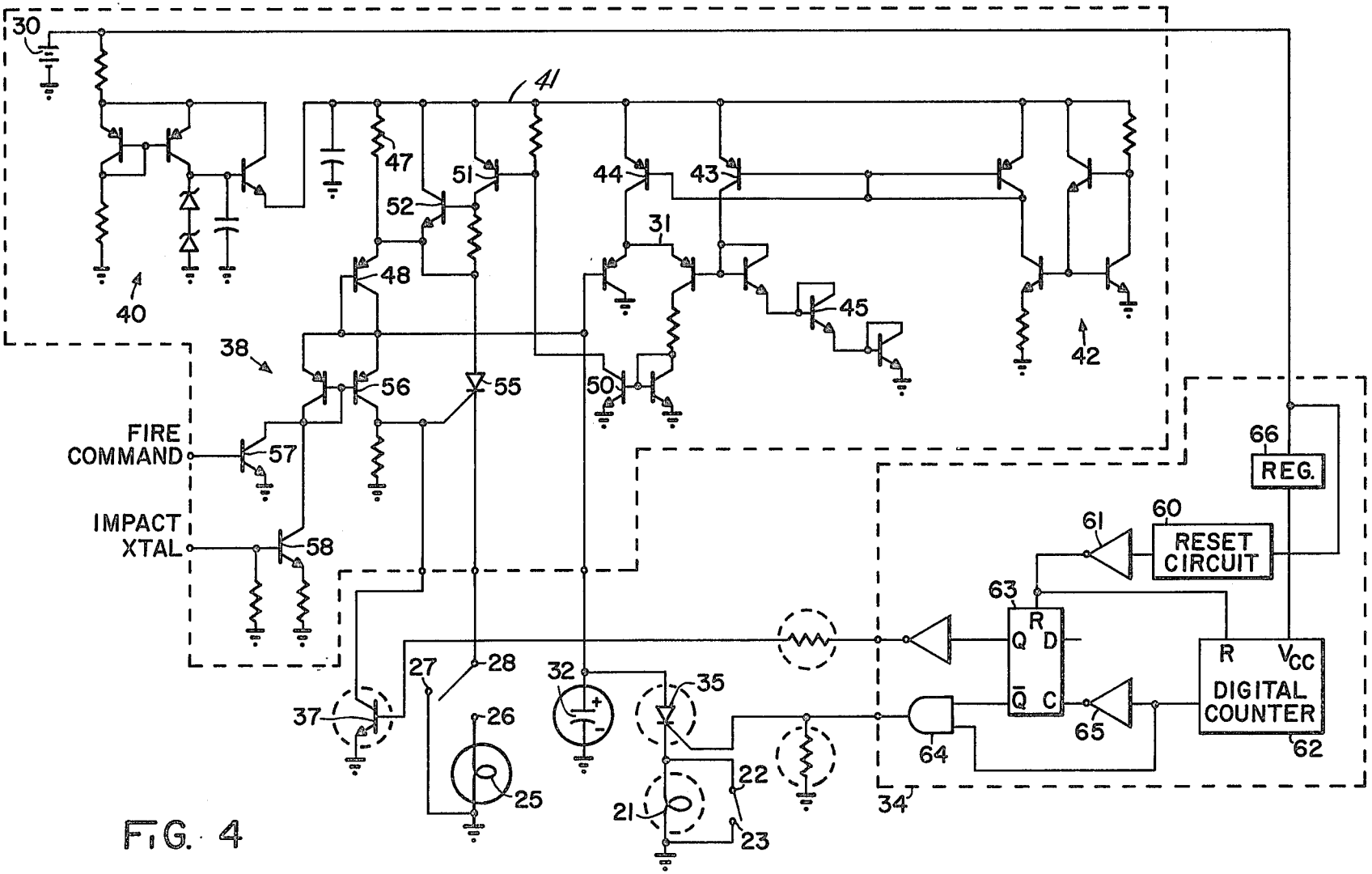
FIG. 4 is a schematic diagram of the electronic circuitry illustrated in block form in FIG. 3.

Referring specifically to FIGS. 1 and 2, the numeral 10 designates a base member having a generally cylindrical shape with a circular cross-section. The axis of the cylinder forming the base member 10 is intended to be coaxial with a spinning explosive projectile on which the base member 10 is mounted and forms a portion of the fuse therefor. An elongated channel is formed in the base member 10 partially along a diameter thereof so as to leave a bottom wall and a wall along one end thereof. A sliding member 12 is mounted in channel 11 for sliding movements in response to spinning of the projectile and, consequently, the base member 10 and initiation of the piston actuator 21. In the Figure, the base member 10 is designed to move with the projectile upwardly along the axis of the base member 10 and to spin in a counterclockwise direction. As is well known in the art, the initial acceleration of the projectile is referred to as "setback" and this term will be used in the remainder of this description.

A spin detent or pin 15 is mounted along a radius of the base member 10 and extends between the sliding member 12 and the base member 10 so as to prevent sliding movement of the member 12 relative to the member 10. A small spring 16 biases the pin 15 partially into the sliding member 12 whenever the projectile is not spinning. Upon proper spinning of the projectile the pin 15 is moved radially outwardly (see FIG. 2) under centrifugal force and releases the sliding member 12 for free movements. In a similar fashion, a setback pin 17 is mounted for movements parallel to the axis of the base member 10 and is positioned so as to fit partially into the sliding member 12 and partially into the base member 10. Upon setback of the projectile the pin 17 disengages the sliding member 12 (see FIG. 2) to release it for sliding movements.

In addition to the spin detent 15 and the setback pin 17, a shear pin 20 is engaged in the sliding member 12 and the base member 10 to prevent relative movement therebetween. An electrically actuatable release device, in this embodiment piston actuator 21, is mounted on the base member 10 so as to bear against an outwardly projecting shoulder on the sliding member 12. Upon receiving a proper electrical signal the piston actuator forces the sliding member 12 radially outwardly to shear the pin 20 and release the sliding member 12 for radial sliding movements under the impetus of the spinning of the projectile, see FIG. 2. The shear pin 20 should be made of a material which is easily sheared under the force of the piston actuator 21 but which will maintain the sliding member immobile until the piston actuator 21 is electrically actuated. The piston actuator 21 has a single electrical coil therein, one side of which is grounded and the other side of which is connected to a fixed contact 22 mounted on the base member 10. A grounded spring contact 23 is biased into contact with the piston contact 22 when the projectile is not spinning and grounds the coil of the piston actuator 21 so that an electrical signal cannot be applied thereto for actuation thereof. When the projectile is properly spinning the centrifugal force moves the spring contact 23 outwardly (see FIG. 2) to disengage the piston contact 22 and unground one side of the piston actuator 21. The contacts 22 and 23 are illustrated schematically in FIGS. 3 and 4.

A detonator device 25, the operation of which is well known to those skilled in the art, is positioned at the inner end of the sliding member 12 so as to be spaced from the axis of the base member 10 prior to arming of the fuse and, upon release of the spin detent 15, the setback pin 17 and the shear pin 20 and sliding of the member 12 outwardly, the detonator 25 is aligned along the axis of the base member 10 and is in position for detonation of the projectile (see FIG. 2). It should, of course, be understood that other positions for the detonator 25 might be devised by those skilled in the art and, in fact, it might be possible for the detonator 25 to be mounted on the base member 10 with the sliding member 12 simply positioned between the detonator 25 and the main charge until it moves to the arm position. The detonator 25 has an electrical contact 26 on the upper end thereof which is in egagement with a grounding plate 27 when the sliding member 12 is locked in the safe position (the position shown in FIG. 1) which grounds both sides of an electric coil in the detonator 25 and prevents inadvertant application of electrical signals thereto. When the sliding member 12 is released and moves to the armed position (the position in FIG. 2) the contact 26 slides into engagement with a contact plate 28 which connects the detonator into an electrical circuit with timing means which will be explained presently. Thus, in the safe position of the sliding member 12 the detonator 25 cannot be energized because there is no circuit thereto and both sides of the actuating coil are grounded. When the member 12 moves into the armed position one side of the actuating coil of the detonator 25 is ungrounded and connected into a circuit for energizing thereof.

FIG. 3 illustrates a block diagram of an electronic system for use with the mechanism illustrated in FIGS. 1 and 2. The electronic system of FIG. 3 is powered by a battery 30, which battery 30 is inactive until setback and spin of the projectile. The battery 30 may be, for example, the type commercially available which includes a vial of acid that is broken upon setback of the projectile and is distributed outwardly during spin to produce the required electrical energy. The energy from the battery 30 is applied through a comparator 31 to a linear or capacitive timer 32. The energy from the battery 30 is also supplied through a comparator 33 to a digital timer 34. The digital timer 34 is designed to operate with AND gate 35 and allow the application of the energy in the capacitive timer 32 to be applied to the piston actuator 21 only after the capacitive timer 32 has stored enough energy to energize the piston actuator 21. The digital timer 34 also supplies a signal to an inhibit circuit 37 to prevent any fire pulse from occurring during the arming sequence. The output of the fire pulse circuit 38 is connected to the detonator 25 through the contacts 28 and 26 upon movement of the sliding member 12 and consequent engagement of the contact 26 with the plate 28 (see FIG. 2). Also, the grounding of the detonator 25 by the contact 26 and plate 27 is illustrated in FIG. 3. Once the inhibit circuit 37 is deactivated, a fire pulse may be generated in the circuit 38 by means of several different commands. For example, an impact crystal may be included in the fuse and upon impact a fire pulse will be generated in the circuit 38, or proximity circuitry might be included in the fuse to command the generation of a fire pulse upon approaching a target, or an external self-destruct command may be transmitted to the fuse, or any of a variety of other commands may be utilized to initiate the fire pulse, depending upon the use of the fuse and the projectile it is attached to.

FIG. 4 illustrates a detailed schematic diagram of the electronic system illustrated in block form in FIG. 3 and similar parts are designated with similar numbers. In FIG. 4, the battery 30 is connected through a regulator and filter, generally designated 40, to a bus line 41. The bus line 41, at the right end thereof, is connected to a current mirror, generally designated 42, which supplies current to turn on a first transistor 43 and a second transistor 44. The transistor 43 supplies current to a chain of three diode connected transistors 45, which provide a fixed reference voltage for one input of the comparator 31. A second input of the comparator 31 is connected to one side of the capacitor timer 32. A charge path is formed for the capacitor 32 from the bus line 41 through a resistor 47 and a diode connected transistor 48. The resistor 47 maintains the charging rate of the capacitor 32 relatively low. Once the charge in the capacitor exceeds the reference value of the diode chain 45 the comparator 31 switches, causing transistors 50 and 51 to operate so that a third transistor 52 conducts shorting out the resistor 47 and greatly increasing the charging rate of the capacitor 32. In actual practice, the capacitor 32 is charged for approximately 25 milliseconds until it reaches a threshold of two volts, at which time the transistor 52 is switched into conduction, and it then charges rapidly in four milliseconds up to its full voltage of eleven volts (the battery 30 is a twelve volt battery).

The capacitor 32 is connected to one input of an AND gate 35, which in this embodiment is the anode of an SCR 35, and the output or cathode of the SCR 35 is connected to one side of the energizing coil of the piston actuator 21. The capacitor is also connected to the anode of a second SCR 55, which is a portion of the fire pulse circuit 38, the cathode of which is connected to the energizing coil of the detonator 25. The remainder of the fire pulse circuit 38 includes a transistor 56 connected to supply an energizing pulse to the gate of the SCR 55 upon receiving a signal from either of a pair of transistors 57 or 58, in turn connected to receive external signals on the bases thereof from circuits not shown. The inhibit circuit 37, in this embodiment, is a transistor designated 37, which is connected between the gate of the SCR 55 and ground so as to maintain the gate at ground and prevent activation of the SCR 55 as long as the transistor 37 is conducting. The transistor 37 receives signals from the digital timer 34, the operation of which will be described presently. Once the transistor 37 is no longer conducting, a signal at the bases of either of the transistors 57 or 58 will produce a gate pulse on the SCR 55 turning on the SCR 55 and allowing the capacitor 32 to discharge into the detonator 25 to detonate the projectile. Also, the gate circuit of the SCR 35 is connected to the digital timer 34 and once a pulse is supplied thereto the SCR 35 is turned on so that the capacitor 32 can discharge therethrough to energize the piston actuator 21 and allow the sliding member 12 and detonator 25 to slide into the arm position. As will be obvious presently, the signal applied to turn on the SCR 35 and the signal applied to cut off the transistor 37 appear at approximately the same time so that a fire pulse must be initiated subsequent to the arming of the fuse or the detonator 25 will not be energized.

Energy from the battery 30 is applied to a reset circuit 60 which includes the comparator 33 (FIG. 3) and holds a reset signal on the digital timer 34 until the voltage supplied by the battery 30 reaches a predetermined value, generally approximately its full value. In this manner, the digital timer 34 does not begin to operate when the battery 30 is low and during which time there might be a danger of improper operation. The reset signal from the reset circuit 60 in FIG. 4 is applied through an inverter 61 to the reset input of a digital counter 62 and to the reset input of a flip-flop 63. For simplicity, the digital counter 62 includes a clock and any other circuits required to provide a pulse at an output thereof a predetermined time after the reset signal is removed therefrom. The timed output pulse from the digital counter 62 is applied directly to one input of an AND gate 64 and, through an inverter 65, to the clock input of the flip-flop 63. The Q output of the flip-flop 63 is applied to the base of the transistor 37 to cause that transistor to cut off, or to remove the inhibit from the fire pulse circuit 38. The $\overline{Q}$ output of the flip-flop 63 is applied to a second input of the AND gate 64, the output of which is connected to the gate of the SCR 35 to produce conduction thereof. The battery 30 is also connected through a regulator 66, which may be similar to the regulator already illustrated, to the digital counter 62 to provide the required voltage for the operation thereof.

In the operation of the present safeing and arming mechanism, setback and spin must occur to remove the spin detent 15 and setback pin 17 and to cause the battery 30 to provide the required energy for the operation of the electronic timing circuits. Without setback and spin no detonation can occur. Upon firing of the projectile and setback and spin occurring, the slide member 12 is released, except for the shear pin 20, and the battery 30 begins to produce electrical energy. In the actual device the battery 30 reaches full voltage in approximately five milliseconds so that the digital counter 62 is reset and begins to operate. The digital timer 34 must be set to supply the arm pulse to the SCR 35 at some time subsequent to the time when the capacitor 32 reaches approximately full charge. During the time that the capacitor 32 is charging relatively slowly (before it reaches two volts) the fuse cannot erroneously arm because the voltage in the capacitor 32 is not sufficient to energize the piston actuator 21 and cause the breaking of the shear pin 20. At least eight volts is required to activate the piston actuator 21, in the present embodiment, and if the SCR 35 is actuated to soon by a pulse from the digital timer 34 the piston actuator 21 will simple short out the capacitor 32 and it will never charge to the correct voltage and, therefore, the fuse will never be armed. In the correct sequence, the capacitor 32 charges to full value and then the SCR 35 is energized by a pulse from the digital timer 34, which causes the capacitor 32 to energize the piston actuator 21 breaking the shear pin 20 and releasing the slide member 12 to move outwardly under centrifugal force. The detonator 25 then moves into position along the axis of the base member 10 and also completes an electrical contact connecting it to the SCR 55 so that a command signal on either of the transistors 57 or 58 will produce a fire pulse turning on the SCR 55 and allowing the capacitor 32 to energize the detonator 25 and explode the projectile.

Thus, an improved safing and arming mechanism for a fuse is disclosed which is extremely reliable and safe. The mechanism has a single sliding member 12 which improves the reliability and the safety is insured by a linear and digital timer which must operate in a correct sequence for the proper arming of the fuse. Further, the comparators, fire pulse circuits, SCRs and associated circuitry are included in a single linear integrated circuit to greatly simplify the manufacture thereof and reduce the size and cost. The digital timer 34 is included in a single digital integrated circuit to aid in reducing the size and cost of the mechanism.

While we have shown and described a specific embodiment of this invention, further modifications and improvements will occur to those skilled in the art. We desire it to be understood, therefore, that this invention is not limited to the particular form shown and we intend in the appended claims to cover all modifications which do not depart from the spirit and scope of this invention.

What is claimed is:

1. An electronic time delay safety and arming mechanism for fuzes on spinning explosive projectiles and the like comprising:
   (a) a base member adapted to be affixed to the projectile;
   (b) a sliding member slideably mounted on said base member for generally radial outward movement from a safe position to an arm position in response to the spinning of the projectile;
   (c) breakable mechanical locking means mounted in engagement with said base member and said sliding member for locking said sliding member in the safe position;
   (d) electrically actuatable release means mounted in engagement with said base member and said sliding member for breaking said locking means to release said sliding member from the safe position upon proper actuation of said release means;
   (e) detonator means mounted so as to be properly positioned for detonation of the projectile only when said sliding member is in the arm position;
   (f) switch means operable in response to the spinning of the projectile and connected to prevent actuation of said release means in a nonspinning mode and to provide a circuit for the actuation of said release means in response to the spinning of the projectile;
   (g) a battery actuatable in response to setback and spin of the projectile; and
   (h) electrical timing means connected to said battery and to said switch means for actuating said release means a predetermined time after actuation of said battery and for arming said detonator means after actuating said release means.

2. An electronic time delay safety and arming mechanism as claimed in claim 1 wherein the breakable mechanical locking means includes a shear pin.

3. An electronic time delay safety and arming mechanism as claimed in claim 1 wherein the electrically actuatable release means includes a piston actuator.

4. An electronic time delay safety and arming mechanism as claimed in claim 1 wherein the detonator means is mounted on the sliding member.

5. An electronic time delay safety and arming mechanism as claimed in claim 1 including in addition spin detent means mounted in engagement with the base member and the sliding member, said spin detent means locking said sliding member in the safe position during nonspinning of the projectile and releasing said sliding member during spinning of the projectile.

6. An electronic time delay safety and arming mechanism as claimed in claim 1 including in addition a setback member mounted in engagement with the base member and the sliding member, said setback member locking said sliding member in the safe position prior to setback and releasing said sliding member upon setback of the projectile.

7. An electronic time delay safety and arming mechanism as claimed in claim 1 wherein the switch means includes a normally closed spring contact positioned to be opened by centrifugal force, or spinning of the projectile.

8. An electronic time delay safety and arming mechanism as claimed in claim 1 including in addition second switch means connected to prevent actuation of the detonator means with the sliding member in the safe position and responsive to movement of the sliding member to the arm position to connect the detonator means to the electrical timing means.

9. An electronic time delay safety and arming mechanism for fuzes on spinning explosive projectiles and the like comprising:

(a) a base member adapted to be affixed to the projectile;

(b) a sliding member slideably mounted on said base member for generally radial outward movement from a safe position to an arm position in response to the spinning of the projectile;

(c) detonator means mounted so as to be properly positioned for detonation of the projectile only when said sliding member is in the arm position;

(d) electrically actuatable release means mounted in engagement with said base member and said sliding member for releasing said sliding member from the safe position upon proper actuation of said release means;

(e) linear timing and electrical energy storage means for providing in a first predetermined time period sufficient electrical energy to actuate said release means;

(f) electrical gate means connecting said timing and storage means to said release means; and (g) digital timing means connected to said gate means for operating said gate means in a second predetermined time period, longer than said first predetermined time period, to allow the electrical energy stored in said timing and storage means to be applied to said release means.

10. An electronic time delay safety and arming mechanism as claimed in claim 9 wherein the linear timing and electrical energy storage means includes a capacitor.

11. An electronic time delay safety and arming mechanism as claimed in claim 9 including in addition electrical inhibit circuitry connected to the detonator means and the digital timing means for preventing detonation of said detonator means until subsequent to the second predetermined time period.

12. An electronic time delay safety and arming mechanism as claimed in claim 9 including in addition a battery actuatable in response to setback of the projectile and circuitry connecting said battery to the linear timing and electrical energy storage means and to the digital timing means for initiating operation thereof.

13. An electronic time delay safety and arming mechanism as claimed in claim 12 wherein the circuitry includes a comparator connected to the battery and the digital timing means and designed to supply an initiating signal to said digital timing means when the output of said battery reaches a predetermined voltage.

* * * * *